United States Patent [19]

Suzuki

[11] Patent Number: 5,069,009

[45] Date of Patent: Dec. 3, 1991

[54] SHELL STRUCTURE AND METHOD OF CONSTRUCTING

[76] Inventor: Toshiro Suzuki, 1160-12, Morooka-cho, Kohoku-ku, Yokohama-shi, Kanagawa 222, Japan

[21] Appl. No.: 474,059

[22] PCT Filed: Aug. 22, 1989

[86] PCT No.: PCT/JP89/00848

§ 371 Date: Apr. 20, 1990

§ 102(e) Date: Apr. 20, 1990

[87] PCT Pub. No.: WO90/02233

PCT Pub. Date: Mar. 8, 1990

[30] Foreign Application Priority Data

Aug. 23, 1988 [JP] Japan ..... 63-209266

[51] Int. Cl.[5] ..... E04B 1/32; E04C 2/42

[52] U.S. Cl. ..... 52/81; 52/660; 52/664; 52/747; 52/DIG. 10

[58] Field of Search ..... 52/81, 660, 106, 664, 52/80, DIG. 10, 747

[56] References Cited

U.S. PATENT DOCUMENTS

| | | | |
|---|---|---|---|
| 297,631 | 4/1884 | Plimsoll | 52/664 |
| 614,008 | 11/1898 | King | 52/106 |
| 2,877,510 | 3/1959 | Bruemmer | 52/660 |
| 2,886,697 | 5/1959 | Pomeroy | 52/660 |
| 4,182,086 | 1/1980 | Crooks | 52/81 |

FOREIGN PATENT DOCUMENTS

| | | | |
|---|---|---|---|
| 772048 | 10/1934 | France | 52/81 |

OTHER PUBLICATIONS

"Tensile Structures", vol. 1, Pneumatic Structures by Frei Otto, the MIT Press, 1967, pp. 158–163.

*Primary Examiner*—David A. Scherbel
*Assistant Examiner*—Deborah McGann Ripley
*Attorney, Agent, or Firm*—James H. Tilberry

[57] ABSTRACT

Domed and cylindrical shell structures of interwoven lightweight strips of metal or other lightweight materials, and method of constructing such shell structures. Several weaving patterns are disclosed which provide requisite flexibility of woven strips to enable the weave to be formed into a desired configuration such as a domed roof or a cylindrical silo. These shells have high strength-to-weight ratios and inherently attenuate seismic vibrations to provide protection against earthquakes. The strips are interwoven on a flat surface at ground level and then hoisted into place. Modules of portions of the shell can be prefabricated and joined to other like modules at the job site to form the complete shell.

38 Claims, 7 Drawing Sheets

SHELL STRUCTURE AND METHOD OF CONSTRUCTING

BACKGROUND OF THE INVENTION

1. Field of the Invention

This invention relates to the field of shell structures used for the structural side walls and roofs of buildings, and methods of constructing such shell structures.

2. Description of Related Art

For lattice-like structures comprising shell-type frames, use has been made of solid truss, rigid joint structural members and cage structure type steel frames in which steel frame members are removably and fixedly connected to each other at respective intersection points, and necessary portions of these steel frame members are tensioned by fastening rods. These structures must be assembled according to a predetermined configuration, and, like the shell of the truss structure, have basically little freedom in the formation of curved surfaces.

Structures of a type using cables are complicated and require means for fixing cables to roof members, or the like.

Conventional shells of the general solid truss structure require great accuracy in the dimension of each member, and involve problems of economic assembly.

The present invention provides improvements over such prior art shell structures.

SUMMARY OF THE INVENTION

A shell structure according to the present invention utilizes elongate strip members, preferably steel, which are relatively easy to bend and twist, by weaving or interlacing the strip members in two or more directions one on another or by providing connections equivalent to weaving or interlacing. The invention comprises two preferred configurations of structure: cylindrical and dome-like.

The respective elongate strip members cross each other orthogonally or obliquely to form a mesh. The intervals between aligned elongate strip members are determined in part out of consideration for ease of interlacing such that the relative positions between the strip members are not largely disordered by the interlacing process.

The respective elongated strip members are overlaid one on another in a planar fashion at respective intersection points, but are not required to be completely fixed to each other during fabrication. When elongated strip members are interlaced one with the other, some displacement or slippage is permitted at their intersection points both linearly and angularly.

The shell structure is fastened with hoop means on its periphery to maintain a predetermined structural configuration, although selected portions of the periphery of the shell structure need not be fastened to the hoops. In order to prevent the shell structure in a set-up condition from being deformed due to wind and/or earthquake, the respective joints may be fixed by bolts, braces may be used partially or wholly, or tension members, such as wire, may be used.

Other embodiments of the invention in lieu of weaving or interlacing are employed when it is difficult to weave or interlace elongated strip members due to restrictions of quality or workability of the strip members. These embodiments simulate weaving or interlacing by utilization of various connecting means where the strips overlap, and are based on the same principle as the woven and interlaced embodiments, to accomplish essentially the same beneficial inventive results.

In addition to elongate flat metal strip members, such as strip steel, the use of reinforced plastic strips is also contemplated. Also, flange-like ribs may be provided on the edges of the strip members which add strength and rigidity to the structure without hindering the means for weaving the strip members. These ribs beneficially provide clearance space for bolt heads and nuts where it is required to use threaded fasteners to secure overlapping strip members. One means of securing the strip members in lieu of weaving is to secure each overlap of strip members by threaded fastener means. Another means of securing strip members in lieu of weaving is to secure short straps over the intersections of strip members. These straps may be secured by threaded fasteners, or by welding, and various combinations of straps may be used. Further, structures may be fabricated in which the elongate strips are made of wood and the bonding straps are made of metal. In addition to orthogonal patterns of strips, three or more strips may be arrayed in other geometric patterns and secured either by weaving or by fastening means.

By weaving or interlacing the elongate strip members on a flat surface, a shell covering such as a plastic film may be superposed over the strip members prior to forming the strip members into the desired final configuration of the shell structure. With the shell covering in place, it is then possible to attach suitable hoisting means to selected medial portions of the woven strip members which can then be hoisted to the desired height of the structure. The strip members will assume the approximate intended configuration of the structure, whereinafter the configuration can be accurately obtained and stabilized by the use of braces and chord members subtending selected concave or underside portions of the shell structure.

Because the woven or interlaced elongate strip members forming the lattice-like shell structure are able to slip and/or slightly rotate one with respect to another of the strip members in overlapping relationship, it is possible to form the shell structure as it is being slowly hoisted from its flat base. When the strip members are steel, additional forming is possible because of the malleability of metals, and, in particular, the malleability of steel. Thus, the strip members may be plastically deformed, if necessary.

The shell structure may also be used as the form for a concrete overlay in addition to serving as means to reinforce the concrete. The shell structure may be used in addition to, or in lieu of, concrete reinforcing bars. It is another feature of the invention that when being used as the form for a concrete structure, the form may be removed from the structure, after the concrete has sufficiently cured, by removing the forming hoop or hoops.

In another embodiment of the invention, the shell structure may be fabricated by preforming the elongate strip members into desired arcuate configurations by use of subtending chord members. The strip members are then sequentially overlapped and secured together.

In summary, the features of the above-described embodiments of the invention are as follows:

(1) Construction of desired curved surfaces.

Since the shell structure is formed by a plurality of strip members woven together to define a latticework, it adapts to change in the curvature of the shell by slight angular changes in the lattice corners. Accordingly, the curved surface is reasonably approximated with slight adjustments of the lattice configuration. Also, since the lattice rigidity is slight and the entire structure is flexible, a desired curved roof is obtainable without the necessity of defining precisely the spatial positions of each lattice member and joint, such as is required with prior art rigid trusses.

(2) Dynamic features of lattice-type shell structure.

A dynamic characteristic of the inventive shell structure is that the rigidity of the individual strip members is low and the entire structure is flexible. When this structure is deformed upon receiving a load, it does not experience the complicated stress conditions or the local stress concentrations inherent in rigid body structures such as trusses and truss joints.

An inplane force within the lattice work of the invention is balanced by the expansion and contraction of the strip members constituting the shell to provide a simple stress condition. Since the strip members are not rigidly fixed at their theoretical points of intersection, secondary stress accompanying the deformation is also slight.

Since the strip members themselves restrain outward deformation one with the other at their intersection points, not only is the buckling length of a strip member shortened, but also the yield strength is prevented from being abruptly reduced. Also, should a strip member fail in stress, the stress after the buckling is redistributed throughout the latticework.

The outward bending of flat and curved strip members is transmitted to the peripheral portion of the structure due to the bending and twisting of the respective crossing strip members.

(3) Vibration attenuating performance.

When the restraining braces and chord members are few in number, the whole structure becomes flexible, and is deformable due to wind and/or earthquake vibrations. However, a large vibration-attenuating effect is inherent in the structure due to the frictional contact of the strip members constituting the latticework of the structure. Accordingly, this inherent friction is positively utilized for earthquake-proof design in structures such as silos, wherein some degree of beneficial deformation is acceptable.

The inventive shell structure and the method of construction according to the present invention are utilized for roofs of various kinds of buildings and/or building frames. The interwoven strip members function like a uniform plate having few stress concentrations, and are advantageously utilized for weight reduction of large spans.

DESCRIPTION OF PREFERRED EMBODIMENTS OF THE INVENTION

Figure 1:
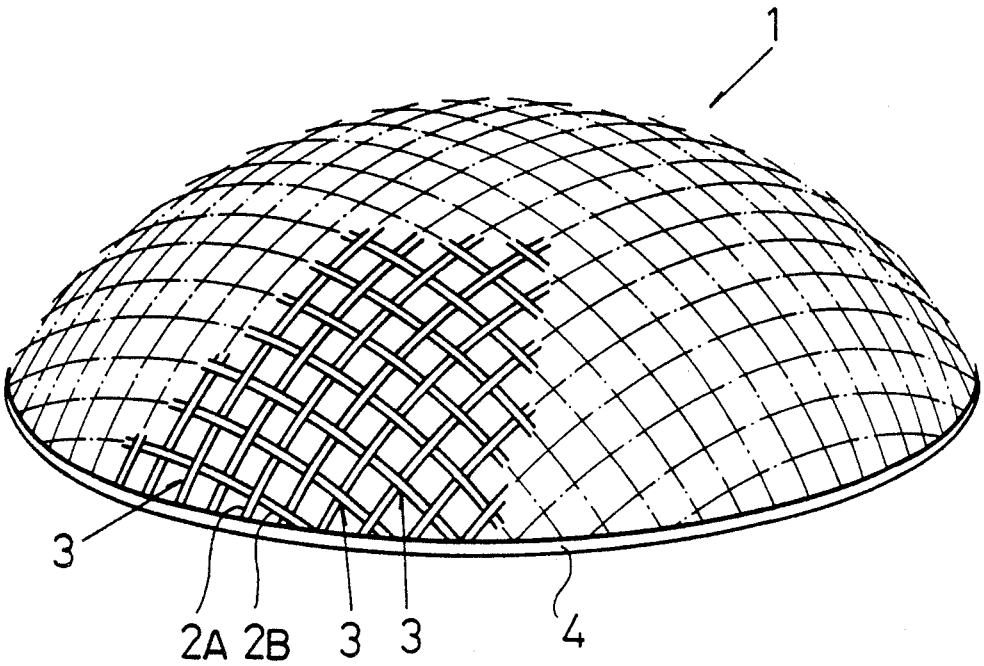
FIG. 1 is a perspective view of a large roof span structure showing schematically an embodiment according to the present invention.

FIG. 1 shows an embodiment of the present invention applied to a shell structure for the frame of a dome roof. Elongate strip members 2A and 2B, formed of thin band steel sheet, are interlaced to form latticework, and the periphery of the latticework is restricted by a hoop 4 formed of steel material or the like serving to define the configuration of the base of shell structure 1.

Figure 2:
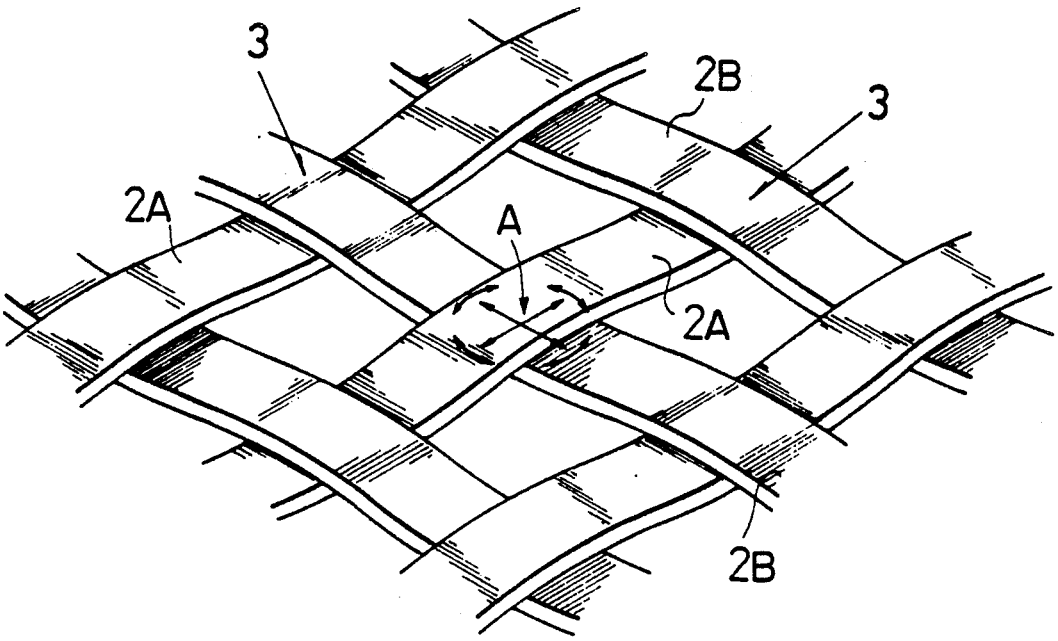
FIG. 2 is a fragmentary perspective view of a preferred embodiment of the invention showing elongate strip members in a woven condition.

During fabrication of the shell 1, the strip members 2 are not mechanically secured together, but instead are interwoven on a flat surface prior to being set up into a predetermined configuration. In FIG. 2, it is shown by the arrows A that some shifting between the strip members 2 at their intersection points is permissible. However, once the dome 1 is formed, in order to resist the deformation forces of wind and/or earthquake, it is preferable that the intersection points 3 be positively fixed by mechanical means, and/or the curvature configuration of the latticework interwoven strip members be maintained by the use of braces and/or chord members. Opposite ends of the members 2 on the periphery of the shell structure 1 are fixed with bolts or welded to the hoop 4.

Figure 14:
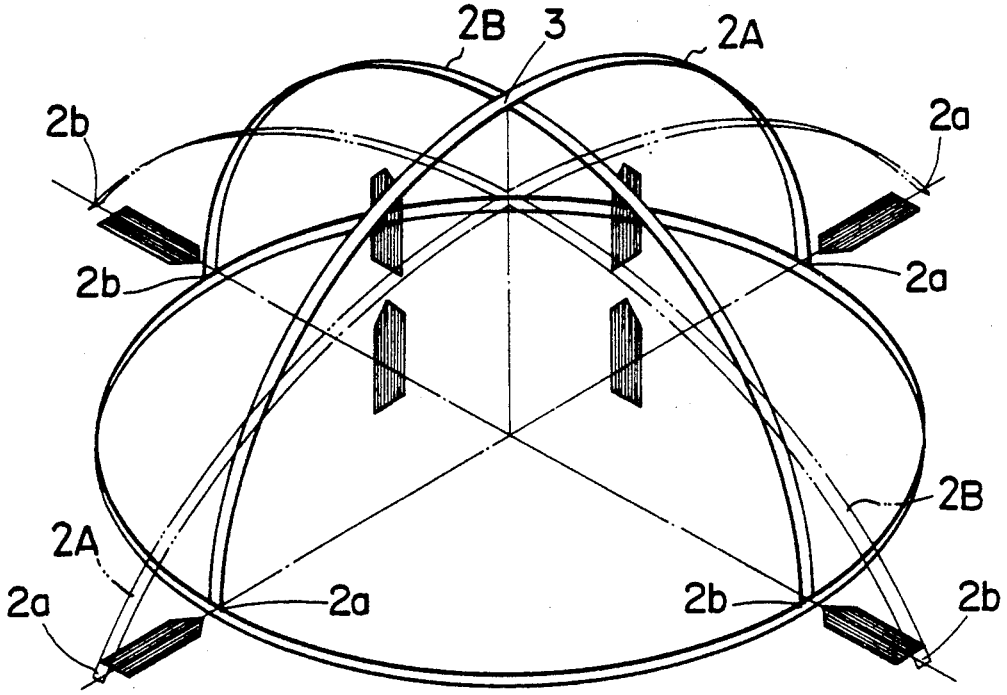
FIG. 14 is a perspective schematic illustration of a method of constructing the inventive shell structure.

In a preferred method of fabricating the inventive dome structure, a plurality of elongate strip members 2 are interwoven on a planar surface to form a flat latticework. Next, as shown in FIG. 14, the central portion and several other medial portions of the latticework are suspended by a crane or raised from beneath the latticework to urge the latticework into the desired curved configuration. The extremities of the strip members 2 are then secured to a hoop 4, whereby the shell structure 1 having the predetermined curved configuration is completed. According to this method of construction, the shell structure is then fixed at the strip member intersection points by bolts after the set-up, or the configuration thereof is maintained by utilizing braces, chord members or the like. In the case where the shell structure is utilized for the frame of a film roof, the strip members 2 are interwoven on the ground and a film member is then placed over and secured to the completed latticework.

Figure 3:
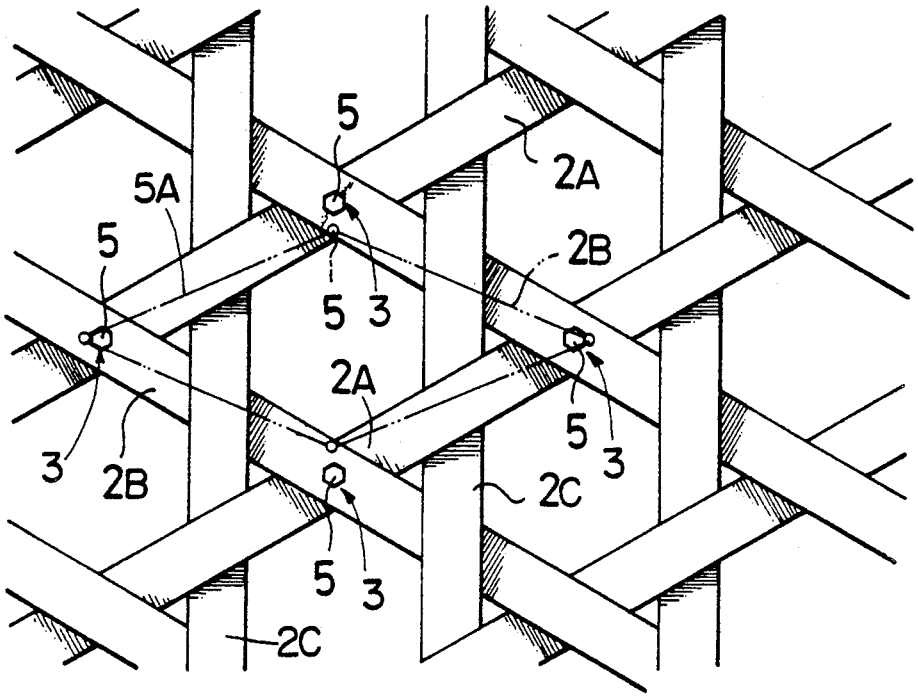
FIG. 3 is a fragmentary plan view of a preferred embodiment of the invention showing elongate strip members woven in three directions.

FIG. 3 shows the strip members 2A, 2B, and 2C interlaced in three directions to form hexagonal spaces therebetween. Strip members 2A and 2B are secured at intersection points 3 by fasteners 5. Strip member 2C is unrestricted with respect to strip members 2A and 2B, thereby permitting some limited movement therebetween. It is also to be noted that adjacent pairs of strip members 2A and 2B form equilateral parallelograms (rhombi), which permit shifting between the strip members 2A and 2B, as shown by the dotted line parallelogram 5A. This relative movement between the strip members permits the shell structure to be easily formed into a desired curved configuration in accordance with the concept of the invention. Thus the strip members are intended not only to bend, but also to shift laterally.

Figure 4:
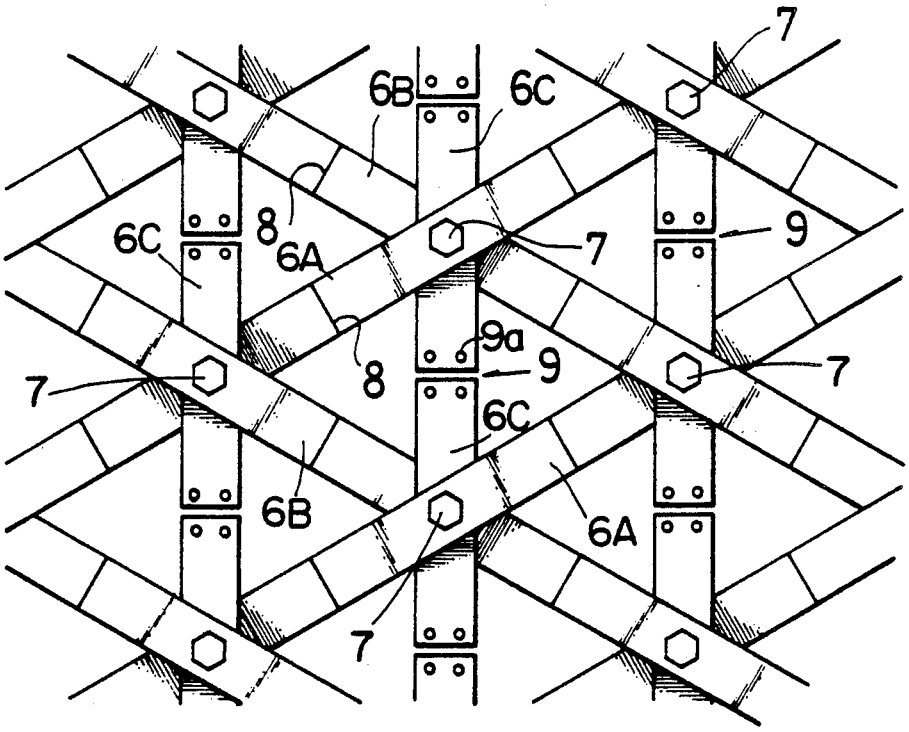
FIG. 4 is a fragmentary plan view of a preferred embodiment of the invention in which the elongate strip members are segmented and have common points of overlap secured by fastening means.

The geometry of the embodiment of the invention shown in FIG. 4 is similar to that of FIG. 3, but the concept is different. In FIG. 3, the strip members are continuous, extending unbroken from one point on the hoop 4 to a second point on the hoop. In FIG. 4, the strip members are made from a plurality of short segments 6A, 6B, and 6C. The segments comprising strip members 6A and 6B, respectively, are butt-welded together at 8 in sufficient number to provide relatively short lengths of strips, which are interwoven together generally in the same manner as shown in FIGS. 2 and 3, to partially form a lattice module. Segments 6C are not joined together, but instead are added to the module in the articulated manner shown in FIG. 4, and held in place by fasteners 7. Gaps 9 are provided between the butt ends of segments 6C to allow for expansion and contraction in forming a predetermined curved surface. After the surface has been formed, segments 6C are then bolted together through preformed bolt holes **9*a* to form continuous strips extending to connecting points on the hoop 4**. These modules can be fabricated at the job site and then assembled at ground level with the requisite additional modules necessary to form the complete latticework.

It will be noted that the fasteners 7 provide the necessary pivot points required for the flexing of the parallelograms formed by welded strip members 6A and 6B. This flexibility enables the interwoven netting of strip members to be conformed to the required curvature of the finished dome. Thereafter strip segments 6C are fastened together by means of preformed bolt holes **9*a* which provide the necessary rigidity to the completed shell structure by preventing further flexing of the parallelograms formed by strip members 6A and 6B**.

Figure 5:
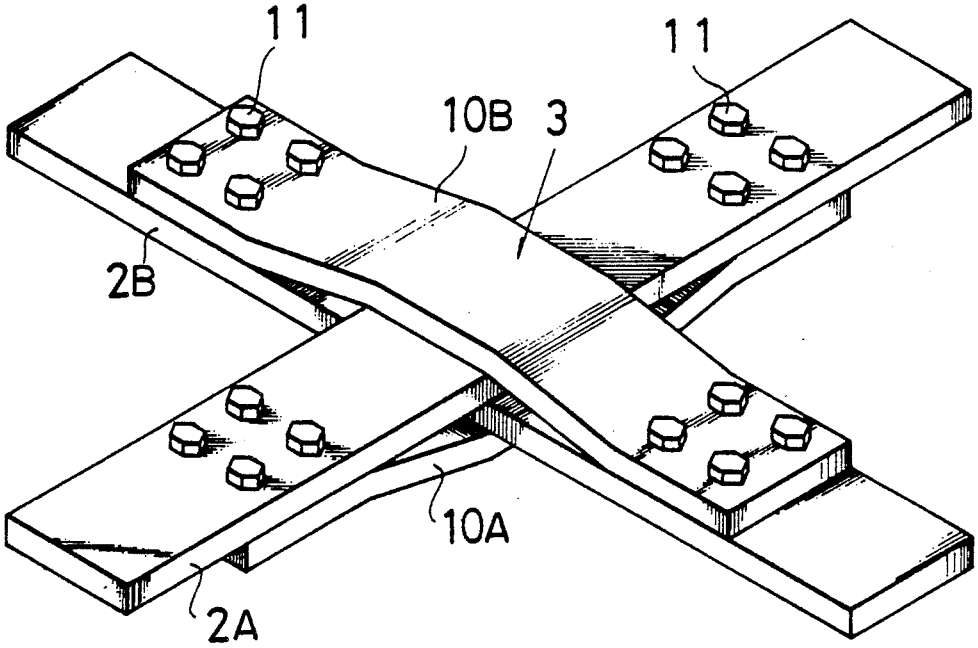
FIG. 5 is a fragmentary perspective view of a preferred embodiment of the invention in which overlay and underlay segmental straps using threaded fasteners define points of strip member overlap.
Figure 6:
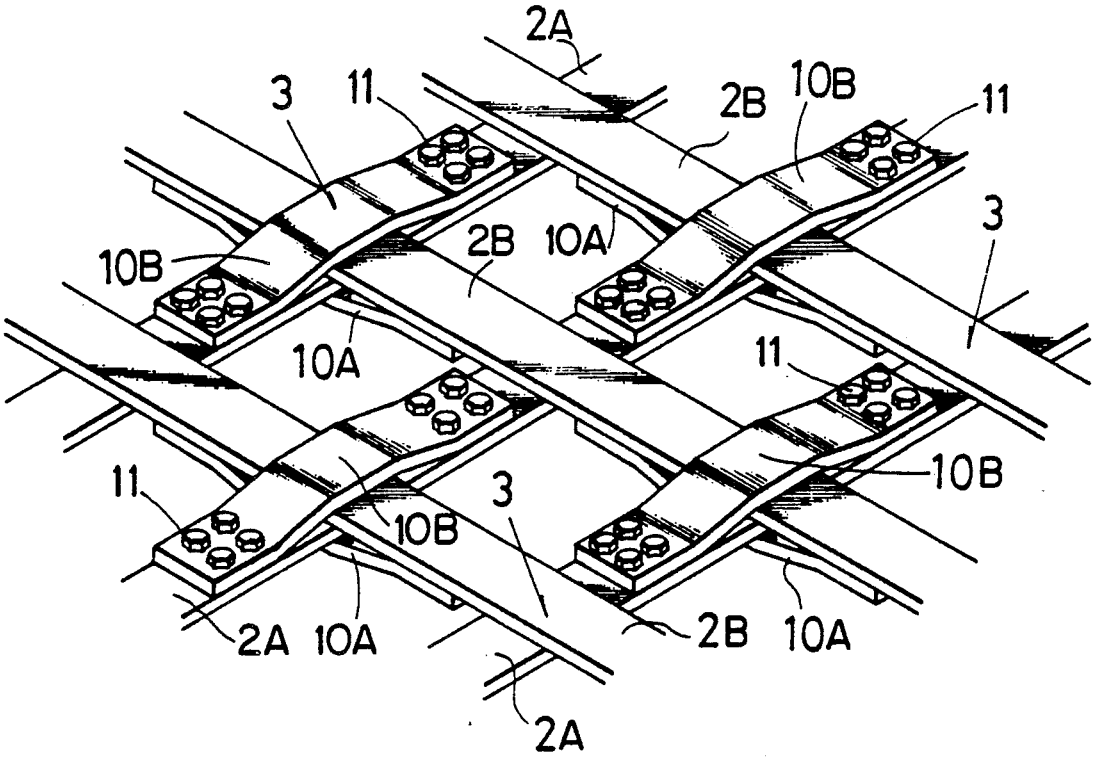
FIG. 6 is a fragmentary perspective view of an embodiment of the invention similar to FIG. 5 showing a latticework of elongate strip members.

FIG. 5 shows an embodiment of the strip member connection with simulated weaving. In this embodiment, the strip members 2A and 2B are not interwoven, but are merely overlaid, whereby the intersection points 3 are defined by cross-over straps 10A and 10B secured to strip members 2A and 2B with bolts 11. As illustrated in FIG. 5, strip members 2A and 2B are sandwiched between cross-over straps 10A and 10B in such a manner as to allow some sliding and pivotal movement between the A and B components. This sandwich-type junction is not necessarily used at all intersection points 3, but may be staggered so that only alternate overlays of strip members, for example, may be secured with cross-over straps 10A and 10B.

Figure 7:
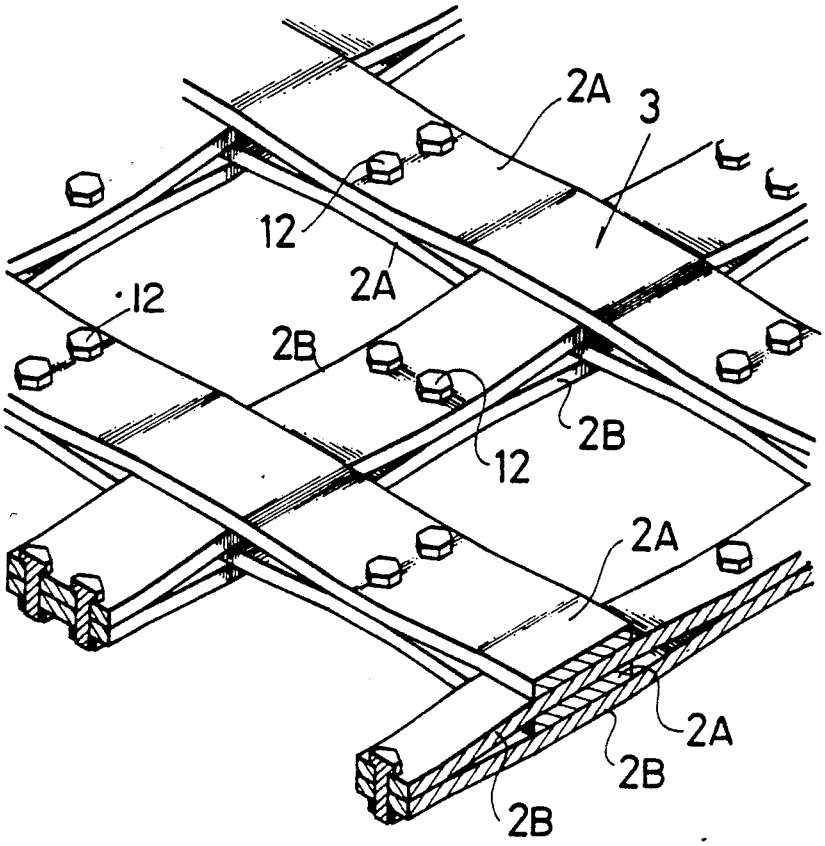
FIG. 7 is a fragmentary perspective view of another embodiment of the invention in which elongate strip members are superposed one on another in superposed interlacing pattern.

In the embodiment of FIG. 7, pairs of strip members 2A—2A and 2B—2B are superposed and interwoven, wherein the upper of the 2B strips are sandwiched between pairs of 2A strips and the lower of the 2A strips are sandwiched between pairs of 2B strips. The intersection points 3 are determined by threaded fasteners 12. This embodiment of the invention has the same freedom of lateral and pivotal movement as the embodiment of FIG. 5, discussed hereinabove. This superposed form of interweaving strip members greatly enhances the overall strength of the structure while losing none of the flexibility at the intersection points 3 necessary for forming the desired arcuate shape of the structure.

Figure 8:
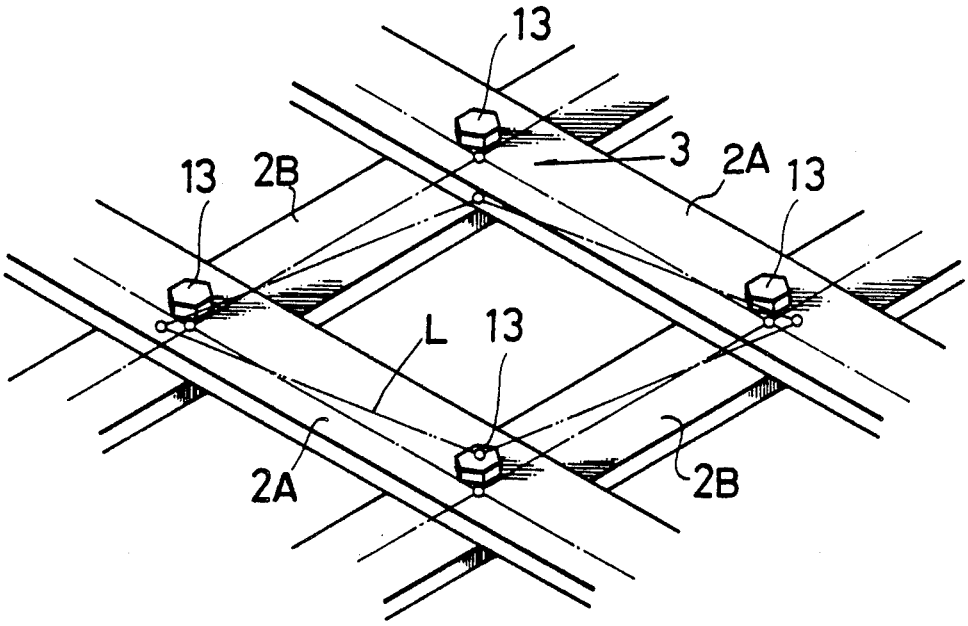
FIG. 8 is a fragmentary perspective view of yet another embodiment of the invention showing a latticework of elongate strip members secured at points of overlap by threaded fasteners.

The embodiment of FIG. 8 is the least complex of the preferred embodiments of the invention. Therein is shown a simple latticework of strip members 2A and 2B secured together with bolts 13, defining a plurality of parallelograms in which bolts 13 provide pivot points about which the parallelograms may flex. Broken lines L indicate the flexibility of the parallelograms. It is understood that it is this flexure that permits the forming of the shell to a specified configuration.

Figure 9:
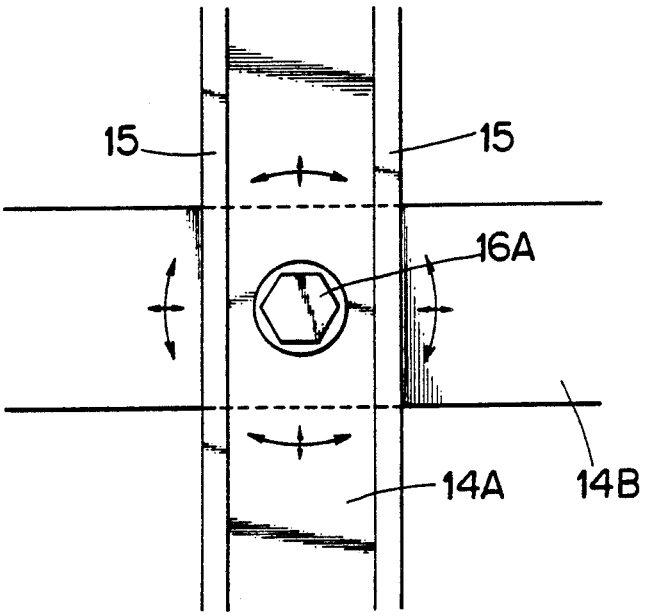
FIG. 9 is a fragmentary plan view of an embodiment of the invention in which the elongate strip members are of channel configuration.
Figure 10:
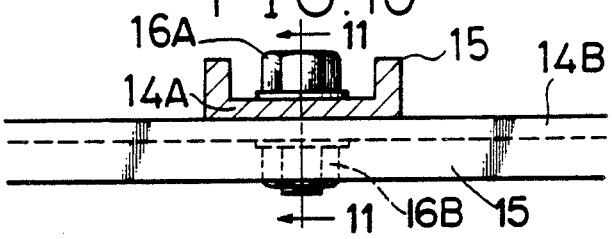
FIG. 10 is a fragmentary, partially sectioned, side elevational view of the embodiment of the invention of FIG. 9.
Figure 11:
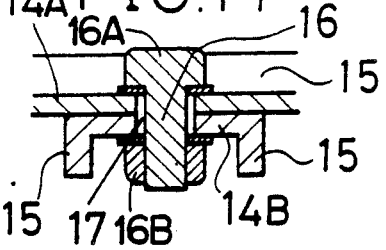
FIG. 11 is a fragmentary, partially sectioned, edge elevational view of the embodiment of the invention taken along the line 11-11 of FIG. 10.

While heretofore have been enumerated the embodiments of flat strips as the strip members, use is also made of strip members 14 provided on both widthwise edges with U-channel-like ribs 15 as shown in FIGS. 9 through 11. In this embodiment, the strip member 14 is somewhat less flexible than the flat strips in bending performance, but the additional strength obtained with U-channel strips renders this embodiment preferable for roofs which must be capable of withstanding heavy loads, such as encountered in northern climates where snow load is a consideration. However, in addition to pivotal flexibility about bolt 16 shown in FIG. 9, enlarged bolt hole 17, FIG. 11, allows for some lateral movement between channel strips 14A and 14B.

Figure 12:
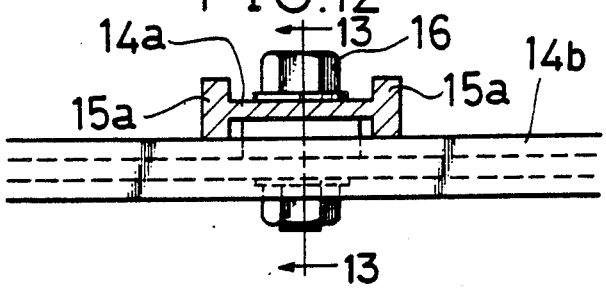
FIG. 12 is a fragmentary, partially sectioned, elevational view of another embodiment of channel elongate strip members used in the invention.
Figure 13:
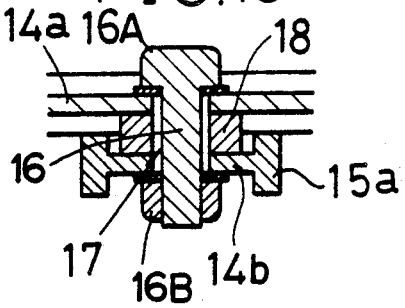
FIG. 13 is a fragmentary, partially sectioned, elevational view of the embodiment of the invention taken along the line 13—13 of FIG. 12.

FIGS. 12 and 13 show a modification of the embodiment of FIGS. 9 through 11, principally in that strip members **14*a* and 14*b* are I-channel strips rather than the U-channel strips of FIGS. 9 through 11. The I flanges 15*a* provide still additional roof load capacity when specified. Otherwise, the functioning of the embodiments of FIGS. 9 and 12 is essentially the same. Both flanges 15 and 15*a* provide recesses for the heads 16A and nuts 16B of bolts 16**.

Figure 15:
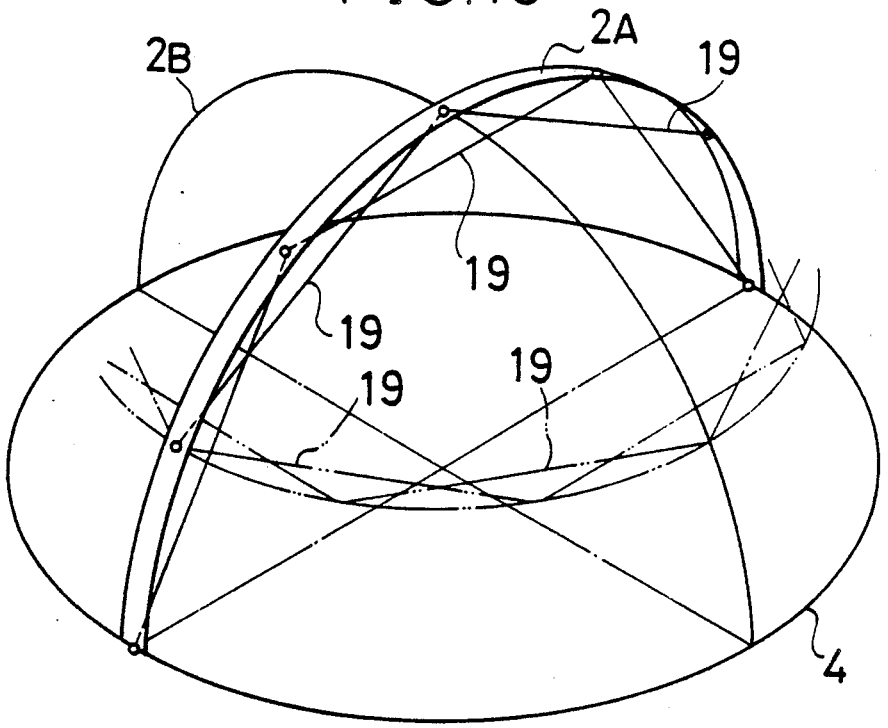
FIG. 15 is a perspective schematic illustration of a method of constructing the inventive shell structure using chord members to subtend arcuate portions of elongate strip members.

FIGS. 14 and 15 schematically illustrate steps of constructing the preferred embodiments of the inventive domed shell. As shown in phantom in FIG. 14, strip members 2A and 2B have been interwoven and are in the process of being hoisted at a central intersection point 3 by an overhead crane, or from beneath the strip members by mechanical jack means well understood by those skilled in the art. When strip extremities **2*a* and 2*b* reach the base hoop 4, they are secured to the hoop and the shell is stabilized. Depending on the rigidity of the interwoven strip members, which varies among the embodiments of FIGS. 2 through 13, the shell may not need further stabilization. However, with the embodiments of the invention such as shown in FIGS. 2, 3, or 8, further stabilization may be desirable, depending on the end use of the shell. If so, the configuration of the shell may be further rigidified by the application of chord members 19 which are used to sequentially subtend consecutive arcs of curvature of the strip members 2A and 2B, as shown in FIG. 15**.

Figure 16:
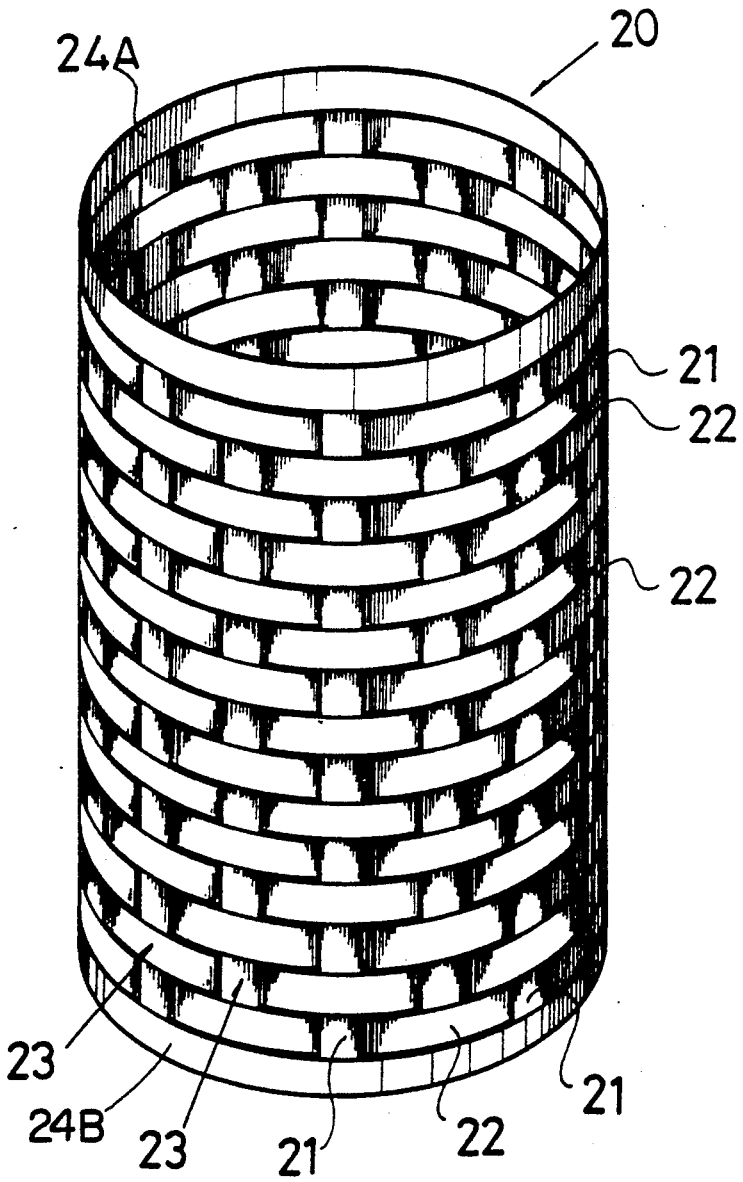
FIG. 16 is a perspective view of an embodiment of the invention applied to the construction of a silo-type building.

FIG. 16 shows an embodiment of the shell structure according to the present invention applied to the side wall of a silo 20. According to this embodiment, vertical strip members 21 and horizontal strip members 22 are interwoven. Horizontal strip members 22 are formed into circular loops, and the end portions of vertical strip members 21 are fixed to upper and lower hoops 24A and 24B. Though not shown, the butt ends of horizontal strip members 22 are joined to each other by means of welding or mechanical fasteners. The strip members make planar frictional contact with each other at intersection points 23, which provide rigidity to the structure. Furthermore, the frictional forces developed between strip members 21 and 22 at intersection points 23 act to attenuate forces of seismic vibration, and therefore provide earthquake protection to the silo.

It will occur to those skilled in the art, upon reading the foregoing description of the preferred embodiments of the invention, taken in conjunction with a study of the drawings, that certain modifications may be made to the invention without departing from the intent or scope of the invention. It is intended, therefore, that the invention be construed and limited only by the appended claims.

I claim:

1. A shell structure comprising: a lattice-like frame having a circular base member, said frame being formed of a first plurality of flexible elongate strip members having opposite end portions, said first plurality of elongate strip members being substantially in parallel alignment and arcuately shaped; a second plurality of flexible elongate strip members having first and second opposite end portions, said first end portions being secured to said base; said second plurality of elongate strip members being substantially in parallel alignment substantially normal to said first plurality of flexible elongate strip members, and said first plurality of flexible elongate strip members being secured to said second plurality of flexible elongate strip members in a manner adapted to maintain the arcuate shape of said first plurality of flexible elongate strip members.

2. The shell structure of claim 1, including a circular member remote from said circular base, and said second end portions being secured to said circular member.

3. The shell structure of claim 1, wherein said first plurality of flexible elongate strip members are interlaced with said second plurality of flexible elongate strip members.

4. The shell structure of claim 1, wherein said first plurality of flexible elongate strip members are formed into complete circles; said second plurality of flexible elongate strip members are linear; and said first and second plurality of flexible elongate strip members are secured together to define a cylindrical shell structure.

5. The shell structure of claim 1, wherein said second plurality of flexible elongate strip members are arcuately shaped, said second end portions are secured to said circular base remote from said first end portions; and said first and said second plurality of flexible elongate strip members are secured together to define a domed shell structure.

6. The shell structure of claim 1, wherein said first second plurality of flexible elongate strip members are secured in a manner adapted to permit slippage therebetween.

7. The shell structure of claim 1, including structural chord means secured to the concave sides of said arcuately shaped flexible elongate strip members to define and to maintain said arcuate shapes.

8. The shell structure of claim 1, wherein said flexible elongate strip members are provided with flange-like stiffening ribs on opposite sides thereof.

9. The shell structure of claim 1, wherein said flexible elongate strip members are formed from strip material with an I-shaped cross section.

10. The shell structure of claim 1, wherein each of said flexible elongate strip members is provided with a cross-over strap secured at the intersection of each pair of normally aligned intersecting flexible elongate strip members adapted to permit limited slippage therebetween.

11. The shell structure of claim 10, wherein said cross-over straps are secured to one surface only of each of said flexible elongate strip members.

12. The shell structure of claim 10, wherein said cross-over straps are secured to opposite sides of each of said flexible elongate strip members.

13. The shell structure of claim 10, wherein said lattice-like frame comprises a plurality of lattice-like, substantially identical, modules of interwoven segments of elongate strip members, and means to secured said modules together to fabricate said shell structure.

14. The shell structure of claim 13, comprising a first plurality of elongate strip segments of a first module adapted to be butt welded to a first plurality of elongate strip segments of a second module.

15. The shell structure of claim 13, comprising a second plurality of elongate strip segments of a first module, and means to interconnect said elongate strip segments within said fist module and to connect said elongate strip segments o said first module to a second plurality of elongate strip segments of an adjacent second module.

16. The shell structure of claim 1, wherein said flexible elongate strip members of each plurality of flexible elongate strip members are secured in superposed pairs with intermittent spaces therebetween to receive flexible elongate strip members of the others of said plurality of flexible elongate strip members to pass therethrough.

17. The shell structure of claim 16, including fastening means to secure said superposed pairs of said flexible elongate strip members between said intermittent spaces.

18. The shell structure of claim 1, wherein said first plurality of elongate strip members are comprised of elongate strip segments butt welded together, end to end.

19. The shell structure of claim 1, wherein said second plurality of elongate strip members comprise: a plurality of elongate strip segments longitudinally aligned and spaced apart; means to secure said elongate strip segments to said first plurality of elongate strip members; and means to integrally secure each of said plurality of said longitudinally aligned, spaced-apart, strip segments to form continuous elongate strip members.

20. The shell structure of claim 1, wherein said first nd second plurality of elongate strip members are interlaced to form parallelograms, and pivotal connecting means at the apices of said parallelograms adapted to permit said parallelograms to partially open and close.

21. The shell structure of claim 20, including means to stabilize said parallelograms from partially opening or closing.

22. The shell structure of claim 1, including a third plurality of elongate strip members aligned substantially parallel and interlaced with said first and second plurality of elongate strip members.

23. The shell structure of claim 22, wherein said first, second, and third plurality of elongate strip members are arrayed to define hexagonal spaces therebetween.

24. The shell structure of claim 22, wherein said first, second, and third plurality of elongate strip members are arrayed to define triangular spaces therebetween.

25. A shell structure comprising: a lattice-like frame forming a predetermined curved surface, said frame being formed of elongate strip members overlaid in at least two directions one on another in a planar fashion on respective intersection points; and fastening means for restricting said elongate strip members from relative displacement between said elongate strip members, the intersection points of said elongate strip members being restrained by said fastening means to thereby provide connections equivalent to interlacing; said fastening means consisting of bolt means and cross-over strap disposed along one elongate strip member so as to span the intersection point of said strip members themselves; said one strip member and said cross-over strap sandwiching the other elongate strip member therebetween; and both ends of each of said cross-over strip being secured to said one elongate strip member by said fastening means.

26. A shell structure comprising: a lattice-like frame forming a predetermined curved surface, said frame being formed of elongate strip members overlaid in at least two directions one on another in a planar fashion on respective intersection points; and fastening means for restricting said elongate strip members themselves from relative displacement between said elongate strip members, the intersection points of said elongate strip members being restrained by said fastening means to provide connections equivalent to interlacing, wherein said elongate strip members is provided on opposite longitudinal edges with flange like ribs.

27. A method of constructing a shell structure having a lattice like frame formed of elongate strip members overlaid one another in at least two directions in a planar fashion on respective intersection points, comprising the teps of:

first, on the ground, overlaying the strip members in at least two directions one another in a planar fashion on respective intersection points:

then forming a lattice-like flat plate so as to allow for the relative displacement and slight rotation in the inplane direction between the respective strip members on the respective intersection points;

hanging up said flat plate on one or several spots of the intermediate portion thereof, while making the peripheral portion of said flat plate to slide to a predetermined position; and then fixing the peripheral portion of said flat plate to the predetermined position to thereby construct the frame of the shell structure having a predetermined curved surface.

28. A constructing method of a shell structure according to claim 27, wherein a film member constituting the shell surface is previously mounted on said shell members overlaid one another on the ground.

29. A constructing method of a shell structure according to claim 18, wherein said respective strip members are secured by fastening means on the respective intersection points after the peripheral portion of said flat plate is made to slide to the predetermined position and then fixed thereto.

30. A constructing method of a shell structure according to claim 29, wherein predetermined intersection points out of said respective intersection points are interconnected through chord members used for holding the configuration of the shell structure after the peripheral portion of said flat plate is made to slide to the predetermined position and fixed thereto.

31. A method of constructing a shell structure having a lattice-like frame formed of strip members overlaid one another in a plane fashion in at least two directions on respective intersection points, comprising the steps of:

setting up said strip members in at least two directions as being overlaid one another in a plannar fashion;

then sequentially combining predetermined sections of said strip members through chord members; and then setting up the frame of the shell structure having a predetermined curved surface as forming the arcuate configuration with a predetermined radius of curvature in the predetermined sections.

32. The method of constructing a shell structure having a lattice-like frame of flexible elongate strip members having opposite end portions, comprising the steps of:

(a) positioning a first plurality of flexible elongate strip members in linear parallel alignment on a flat surface;

(b) positioning a second plurality of flexible elongate strip members in linear parallel alignment in overlaid fashion on said first plurality of flexible elongate strip members and substantially normal thereto;

(c) securing said first plurality of flexible elongate strip members to said second plurality of flexible elongate strip members so as to allow relative displacement and slight pivotal movement between adjacent members of said first and second plurality of flexible elongate strip members;

(d) securing the plurality of said flexible elongate strip members to hoisting means at a position intermediate said end portions;

(e) hoisting with said hoisting means said flexible elongate strip members vertically upward a predetermined distance;

(f) securing said end portions to the periphery of a planar base of preselected configuration;

(g) releasing said hoisting means from said plurality of said flexible elongate strip members; and (h) permitting said plurality of said flexible elongate strip members to assume an unsupported configuration.

33. The method of claim 32, wherein said flexible elongate strip members have convex and concave sides, and the step of securing structural chord members to said concave sides to stabilize said shell structure.

34. The method of claim 32, including the step of interlacing said first and second plurality of flexible elongate strip members.

35. The method of claim 32, including the step of securing said first and second plurality of flexible elongate strip members with cross-over straps adapted to bridge normally intersecting flexible elongate strip members.

36. The method of claim 32, including the steps of stabilizing said shell structure and applying an exterior surface cover to said shell structure.

37. The method of claim 36, including the steps of applying a film over said shell structure and applying an outer layer of roofing material over said film.

38. The method of claim 32, including the step of selecting the lengths of said flexible elongate strip members so that each member will assume an arcuate shape when secured to said periphery of said planar base which complements the arcuate shapes of adjacent parallel and intersecting strips to define an arcuate dome-like shell structure.

* * * * *